US011176820B2

(12) United States Patent
Singh et al.

(10) Patent No.: US 11,176,820 B2
(45) Date of Patent: Nov. 16, 2021

(54) HOST VEHICLE WARNING SYSTEMS AND METHODS

(71) Applicant: Toyota Motor North America, Inc., Plano, TX (US)

(72) Inventors: Khushboo Singh, The Colony, TX (US); Eduard VanderSmitte, McKinney, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 0 days.

(21) Appl. No.: 16/700,172

(22) Filed: Dec. 2, 2019

(65) Prior Publication Data

US 2021/0166560 A1 Jun. 3, 2021

(51) Int. Cl.

| | |
|---|---|
| ***G08G 1/0965*** | (2006.01) |
| ***G08G 1/087*** | (2006.01) |
| ***G08B 1/08*** | (2006.01) |
| ***G08G 1/0967*** | (2006.01) |
| ***G08G 1/01*** | (2006.01) |

(52) U.S. Cl.
CPC ..... *G08G 1/096791* (2013.01); *G08G 1/0112* (2013.01)

(58) Field of Classification Search
CPC ..... G05D 1/024; G08G 1/16; G08G 1/096791
See application file for complete search history.

(56) References Cited

U.S. PATENT DOCUMENTS

| | | | | |
|---|---|---|---|---|
| 8,355,852 | B2 | 1/2013 | Grimm et al. | |
| 8,907,814 | B2 | 12/2014 | Chen | |
| 10,140,861 | B2 | 11/2018 | Gupta et al. | |
| 2006/0293856 | A1* | 12/2006 | Foessel | G01S 13/931 701/301 |
| 2009/0231155 | A1 | 9/2009 | Kovarnik | |
| 2018/0075309 | A1* | 3/2018 | Sathyanarayana | G06N 7/005 |
| 2018/0301033 | A1 | 10/2018 | Oshida | |
| 2019/0043358 | A1* | 2/2019 | Biehle | G08G 1/162 |
| 2019/0088135 | A1* | 3/2019 | Do | G05D 1/0055 |
| 2019/0156134 | A1* | 5/2019 | Krishnan | A61B 5/225 |
| 2020/0008028 | A1* | 1/2020 | Yang | G08G 1/012 |
| 2020/0148108 | A1* | 5/2020 | Kumashiro | B60Q 9/008 |
| 2021/0061265 | A1* | 3/2021 | Furtado | B60W 30/085 |

* cited by examiner

*Primary Examiner* — Joseph H Feild
*Assistant Examiner* — Pameshanand Mahase
(74) *Attorney, Agent, or Firm* — Dinsmore & Shohl LLP

(57) ABSTRACT

A host vehicle warning system includes one or more processors, one or more host vehicle status sensors, one or more approaching vehicle sensors, one or more user interface devices, and one or more memory modules. The one or more host vehicle status sensors output a status signal that a host vehicle is stopped in traffic. The one or more approaching vehicle sensors output a driving condition signal indicative of a driving condition of an approaching vehicle. The one or more user interface devices output a warning to a user of the host vehicle. The one or more memory modules store logic that cause the one or more processors to determine that the host vehicle is stopped in traffic, detect the driving condition of the approaching vehicle, determine whether the driving condition of the approaching vehicle is reckless, and output the warning in response to determining the approaching vehicle is reckless.

16 Claims, 3 Drawing Sheets

HOST VEHICLE WARNING SYSTEMS AND METHODS

TECHNICAL FIELD

The present specification generally relates to systems and methods for providing warnings and, more specifically, host vehicle warning systems and methods for issuing a warning in response to detection of a reckless driven vehicle.

BACKGROUND

Vehicle operators may need to exit their vehicle during vehicle failure events (e.g., vehicle breakdown, tire replacement, etc.). In such situations, a vehicle operator or other occupant will typically exit the vehicle to, for example, survey the damage, change a tire, make repairs, etc. While most approaching driver and/or vehicles may notice the vehicle operator/occupant outside of the vehicle and take precautionary measures, other drivers and/or vehicles may not notice the person. This may be especially true for an approaching vehicle that is driving recklessly.

Accordingly, a need exists for alternative systems and methods for issuing a warning in response to detection of a recklessly driven vehicle.

SUMMARY

In one embodiment, a host vehicle warning system includes one or more processors, one or more host vehicle status sensors, one or more approaching vehicle sensors, one or more user interface devices, and one or more memory modules. The one or more host vehicle status sensors are communicatively coupled to the one or more processors and are configured to output a status signal that a host vehicle is stopped in traffic. The one or more approaching vehicle sensors are communicatively coupled to the one or more processors and are configured to output a driving condition signal indicative of a driving condition of an approaching vehicle. The one or more user interface devices are communicatively coupled to the one or more processors and are configured to output a warning to a user of the host vehicle. The one or more memory modules are communicatively coupled to the one or more processors and store logic that when executed by the one or more processors cause the one or more processors to determine that the host vehicle is stopped in traffic based on the status signal output by the one or more host vehicle status sensors, detect the driving condition of the approaching vehicle based on the driving condition signal output by the one or more approaching vehicle sensors, determine whether the driving condition of the approaching vehicle is reckless based on the driving condition signal output by the one or more approaching vehicle sensors, and output the warning with the one or more user interface devices in response to determining that the driving condition of the approaching vehicle is reckless.

In another embodiment, a method of issuing a warning in response to detection of a recklessly driven vehicle, the method includes determining the a host vehicle is stop in traffic based on a status signal output by one or more host vehicle status sensors, detecting a driving condition of an approaching vehicle based on a driving condition signal output by one or more approaching vehicle sensors, determining whether the driving condition of the approaching vehicle is reckless based on the driving condition signal output by the one or more approaching vehicle sensors, and outputting with one or more user interface devices a warning in response to determining that the driving condition of the approaching vehicle is reckless.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
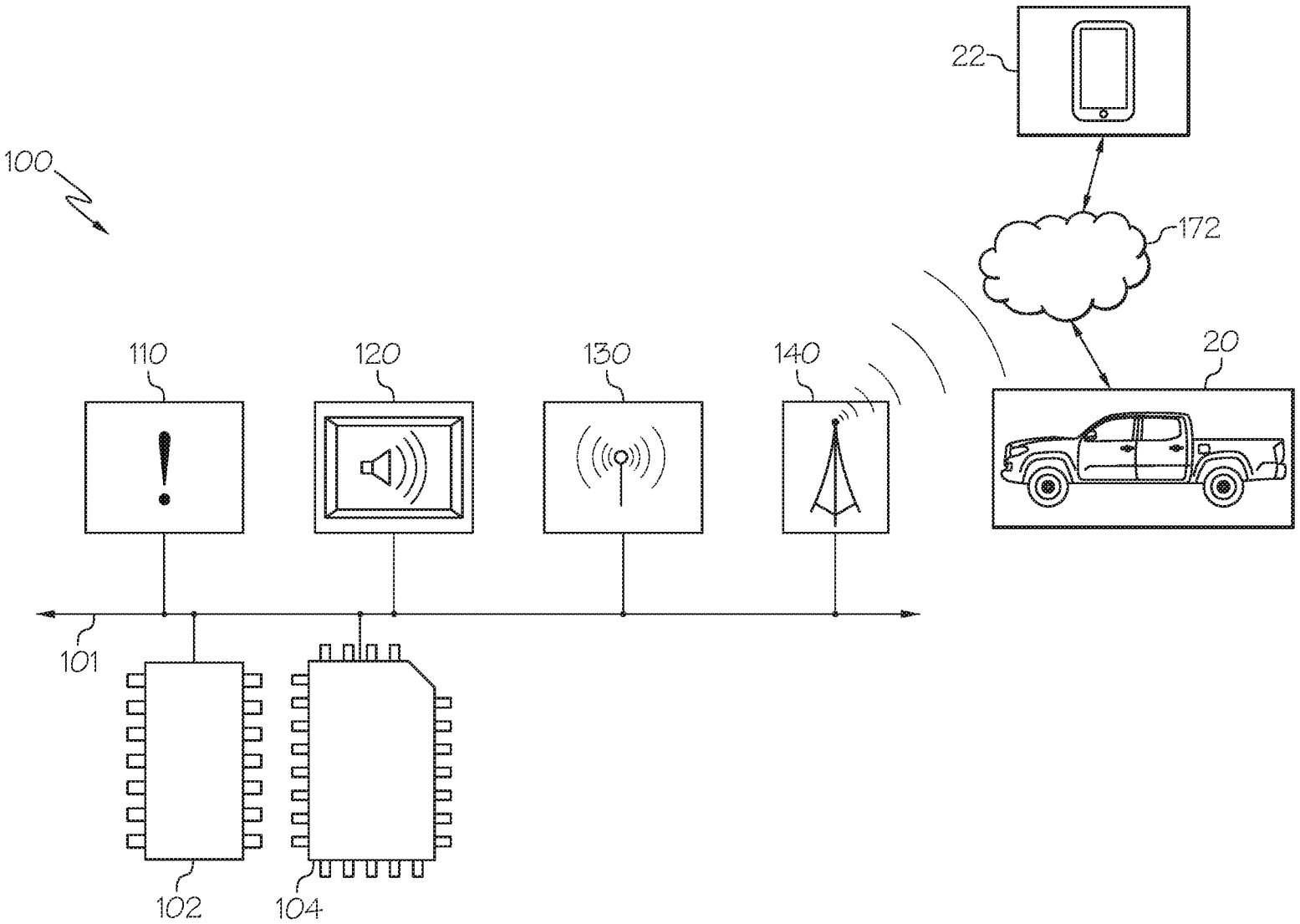
FIG. 1 schematically illustrates a host vehicle warning system, according to one or more embodiments shown and described herein.

Referring generally to FIG. 1, embodiments of the present disclosure are directed to systems and methods for issuing a warning in response to detection of a recklessly driven vehicle. In particular, such warnings are issued when a vehicle is stopped in traffic such as, for example, when the vehicle is disabled (e.g., due to a flat tire, engine failure, over-heating, or the like). In particular, the stopped vehicle, referred to herein as the "host vehicle" includes a host vehicle warning system. The host vehicle warning system generally includes one or more processors, one or more host vehicle status sensors, one or more approaching vehicle sensors, one or more user interface devices, and one or more memory modules. The one or more host vehicle status sensors output a status signal that a host vehicle is stopped in traffic. The one or more approaching vehicle sensors output a driving condition signal indicative of a driving condition of an approaching vehicle. The one or more user interface devices output a warning to a user of the host vehicle. The one or more memory modules store logic that cause the one or more processors to determine that the host vehicle is stopped in traffic, detect the driving condition of the approaching vehicle, determine whether the driving condition of the approaching vehicle is reckless, and output the warning in response to determining the approaching vehicle is reckless. Accordingly, a warning may be provided to the user of the disabled vehicle to warn the user of an oncoming reckless driver to allow the user to take preventative measures (e.g., step away from the host vehicle or the road). Various embodiments of the host vehicle warning system and methods will be described in more detail herein.

Referring now to FIG. 1, a host vehicle 10 having host vehicle warning system 100 is schematically illustrated. It is noted that the host vehicle 10 may be any terrestrial, aquatic, or airborne vehicle.

The host vehicle warning system 100 may be integrally incorporated into the systems of the host vehicle 10 (e.g., a vehicle infotainment system) or separate therefrom (e.g., an add-on system that may be plugged into the host vehicle 10). The host vehicle warning system 100 includes a communication path 101, one or more processors 102, one or more memory modules 104, one or more host vehicle status sensors 110, one or more approaching vehicle sensors 130, and one or more user interface devices 120. Additionally, the host vehicle warning system 100 may include network interface hardware 140 that allows the host vehicle warning system 100 to communicate with a network 172. It is noted that while the host vehicle warning system 100 illustrates a number of modules communicatively coupled to one another over the communication path 101, a greater or fewer number of modules may be included without departing from the scope of the present disclosure.

As described above, the host vehicle warning system 100 includes a communication path 101 that provides data interconnectivity between various modules disposed within the host vehicle warning system 100. Specifically, each of the modules can operate as a node that may send and/or receive data. In some embodiments, the communication path 101 includes a conductive material that permits the transmission of electrical data signals to processors, memories, sensors, and actuators throughout the host vehicle warning system 100. In another embodiment, the communication path 101 can be a bus, such as for example a LIN bus, a CAN bus, a VAN bus, and the like. In further embodiments, the communication path 101 may be wireless and/or an optical waveguide. Components that are communicatively coupled may include components capable of exchanging data signals with one another such as, for example, electrical signals via conductive medium, electromagnetic signals via air, optical signals via optical waveguides, and the like.

The host vehicle warning system 100 includes one or more processors 102 communicatively coupled with one or more memory modules 104. The one or more processors 102 may include any device capable of executing machine-readable instructions stored on a non-transitory computer-readable medium. Accordingly, each processor 102 may include a controller, an integrated circuit, a microchip, a computer, and/or any other computing device.

The one or more memory modules 104 are communicatively coupled to the one or more processors 102 over the communication path 101. The one or more memory modules 104 may be configured as volatile and/or nonvolatile memory and, as such, may include random access memory (including SRAM, DRAM, and/or other types of RAM), flash memory, secure digital (SD) memory, registers, compact discs (CD), digital versatile discs (DVD), and/or other types of non-transitory computer-readable mediums. Depending on the particular embodiment, these non-transitory computer-readable mediums may reside within the host vehicle warning system 100 and/or external to the host vehicle warning system 100. The one or more memory modules 104 may be configured to store one or more pieces of logic, as described in more detail below. The embodiments described herein may utilize a distributed computing arrangement to perform any portion of the logic described herein.

Embodiments of the present disclosure include logic stored on the one or more memory modules 104 that includes machine-readable instructions and/or an algorithm written in any programming language of any generation (e.g., 1GL, 2GL, 3GL, 4GL, and/or 5GL) such as, machine language that may be directly executed by the one or more processors 102, assembly language, obstacle-oriented programming (OOP), scripting languages, microcode, etc., that may be compiled or assembled into machine readable instructions and stored on a machine readable medium. Similarly, the logic and/or algorithm may be written in a hardware description language (HDL), such as logic implemented via either a field-programmable gate array (FPGA) configuration or an application-specific integrated circuit (ASIC), and their equivalents. Accordingly, the logic may be implemented in any conventional computer programming language, as pre-programmed hardware elements, and/or as a combination of hardware and software components.

As noted above, the host vehicle warning system 100 further includes one or more host vehicle status sensors 110 coupled to the communication path 101 such that the communication path 101 communicatively couples the one or more host vehicle status sensors 110 to other modules of the host vehicle warning system 100. The one or more host vehicle status sensors 110 may include any sensor or combination of sensors configured to output a status signal that a host vehicle 10 is stopped in traffic. For example, and not as a limitation, the one or more host vehicle status sensors 110 may include accelerometers, speedometers, vehicle cameras, LIDAR, RADAR, or any combination thereof. For example, an accelerometer or speedometer may provide an output indicative of whether or not the host vehicle 10 is moving. A camera, LiDAR, or RADAR, may provide output indicative of objects moving around the stopped host vehicle 10. Accordingly, using the output of one or more host vehicle status sensors 110, the host vehicle warning system 100 may determine that the host vehicle 10 is stopped in traffic. In some embodiments, the host vehicle status sensors 110 may include communications received from other vehicles (e.g., through vehicle-to-vehicle communication) where the other vehicle outputs a signal to the host vehicle 10 which indicates to the host vehicle warning system 100 that the host vehicle 10 is stopped in traffic. When it is determined that the host vehicle 10 is stopped in traffic, the host vehicle warning system 100 may automatically begin monitoring an environment of the host vehicle 10 for recklessly driven vehicles.

In some embodiments, the one or more host vehicle status sensors 110 may include sensors configured to output indicative of a problem with the host vehicle 10, in response to which the host vehicle 10 should be stopped, e.g., low battery, over-heating, engine problems, flat tire, or the like. Such sensors may include, but are not limited battery sensors, engine sensors, oil sensors, tire sensors, or the like. In such embodiments, when the one or more host vehicle warning system 100 detects that the host vehicle 10 should be stopped due to a problem with the host vehicle 10, the host vehicle warning system 100 may automatically begin monitoring the environment of the host vehicle 10 for recklessly driven vehicles.

Figure 3:
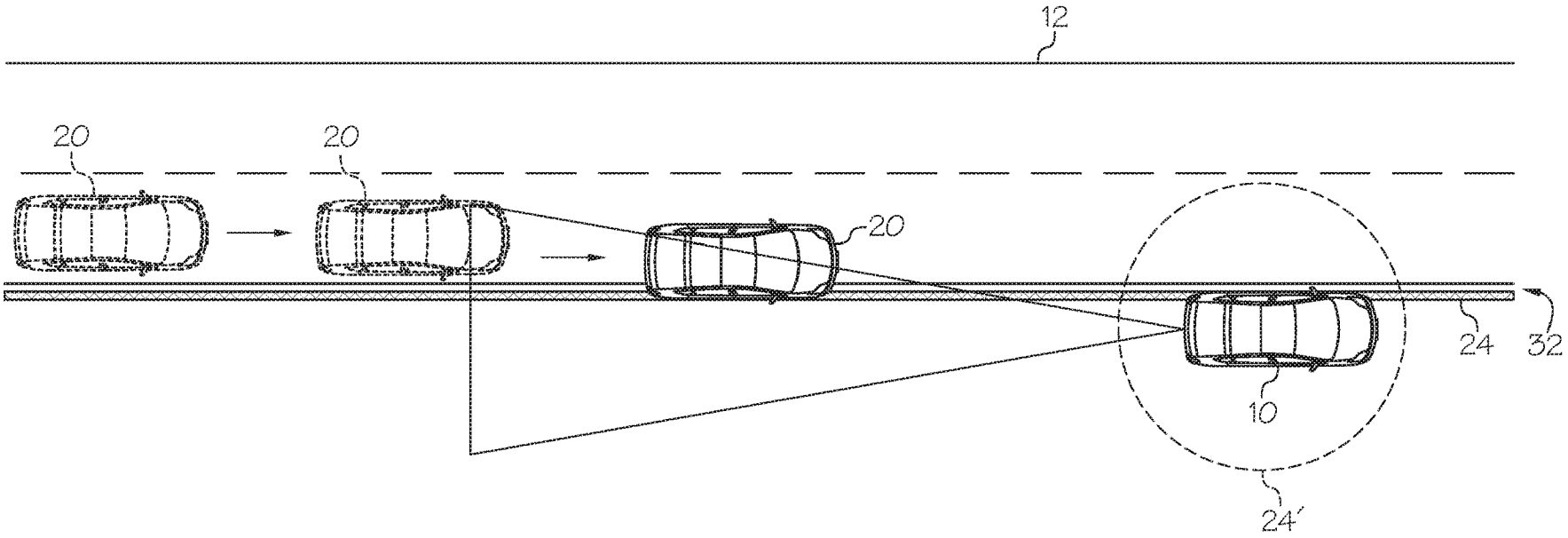
FIG. 3 depicts a vehicle stopped in traffic, according to one or more embodiments shown and described herein.

In yet further embodiments, the one or more host vehicle status sensors 110 may include a satellite antenna, the satellite antenna may be configured to receive location signals from GPS satellites. Specifically, in at least one embodiment, the satellite antenna includes one or more conductive elements that interact with electromagnetic signals transmitted by GPS satellites. The received location signal is transformed into a data signal indicative of the location (e.g., latitude and longitude) of the host vehicle 10 by the one or more processors 102. Based on changes to the location signal, or lack thereof, the host vehicle warning system 100 may determine that the host vehicle 10 is stopped. In some embodiments, the host vehicle warning system 100 may correlate the received location signal to map information stored on the one or more memory modules 104 or otherwise available to the one or more processors 102 to determine whether the host vehicle 10 is positioned on a shoulder of the road 12, such as illustrated in FIG. 3.

Referring again to FIG. 1, to monitor for a recklessly driven vehicle, the host vehicle warning system 100 includes one or more approaching vehicle sensors 130 communicatively coupled to the one or more processors 102 over the communication path 101. The one or more approach vehicle sensors 13 may include any device configured to output to the one or more processors 102 a driving condition signal indicative of a driving condition of an approaching vehicle. That is, based on the driving condition signal output by the one or more approaching vehicle sensors 130, the one or more processors 102 may execute logic stored on the one or more memory modules 104 to determine whether the driving condition of an approaching vehicle is reckless.

Such sensors may include, but are not limited to RADAR, LiDAR, a camera, vehicle-to-vehicle communication, or any combination thereof. Using RADAR, LiDAR, or a vehicle camera (e.g., a back-up camera or other vehicle camera) the host vehicle warning system 100, may locate and track the travel path, or other characteristics, of an approaching vehicle. For example, the host vehicle warning system 100 may, using the output of the one or more approaching vehicle sensors 130, monitor an approaching vehicle for speed, swerving, drifting, or the like. In some embodiments, an approaching vehicle traveling above a predetermined speed, (e.g., over the speed limit, 5 mph over the speed limit, 10 mph over the speed limit, 20 mph over the speed limit, etc.) may cause the one or more processors 102 to determine that the approaching vehicle is driving recklessly. In some embodiments an approaching vehicle that is swerving, drifting, or otherwise not maintaining a consistent travel path may cause the one or more processors 102 to determine that the approaching vehicle is driving recklessly.

In some embodiments, vehicles equipped for vehicle-to-vehicle communication may be monitoring their own driving behavior. In such instances, the approaching vehicle itself may be providing information to the host vehicle 10, which allows the host vehicle 10 to determine that the approaching vehicle is driving recklessly. Such information may include, but is not limited to, speed, acceleration, stability, driver distraction, or the like.

Referring to FIG. 3, in some embodiments indications of reckless driving may be provided when the approaching vehicle encroaches on a virtual boundary 24 generated by the host vehicle warning system 100. For example, where the host vehicle 10 is pulled over on the shoulder of the road 12, which may be determined based on the one or more host vehicle status sensors 110, the virtual boundary 24 may sit between the edge of the road 12 and the host vehicle 10. In yet further embodiments, the virtual boundary 24 may be arranged as a zone 24' around the host vehicle 10. When it is determined, using the one or more approaching vehicle sensors 130, that the approaching vehicle has violated (e.g., encroached or crossed) by the approaching vehicle 20, the warning may be output be the one or more user interface devices 120.

The one or more user interface devices 120 are communicatively coupled to the one or more processors 102 over the communication path 101. The one or more user interface devices 120 may include one or more vehicle displays, audio systems (e.g., one or more interior and/or exterior speakers), haptic feedback systems, one or more vehicle lights (e.g., emergency lights, interior lights, headlights, taillights, or the like) and/or similar systems used for outputting information to a user. Where a user of the host vehicle 10 may be expected to be outside of the vehicle due to, e.g., changing the vehicle tire, checking the engine, surveying damage, or the like, the host vehicle warning system 100 may include exterior speakers and/or lights which may be activated to provide warning audibly or visually such that the user knows that they may potentially be in the way of an approaching vehicle 20 which is driving recklessly. Other warnings may include display of a notification on a display within the vehicle, changing interior lighting, playing an audible sound within the interior, etc.

Still referring to FIG. 1, the host vehicle warning system 100 may further include network interface hardware 140 for communicatively coupling the system 100 with a network 172. The network interface hardware 140 can be communicatively coupled to the communication path 101 and can be any device capable of transmitting and/or receiving data via the network 172. Accordingly, the network interface hardware 140 can include a communication transceiver for sending and/or receiving any wired or wireless communication. For example, the network interface hardware 140 may include an antenna, a modem, LAN port, Wi-Fi card, WiMax card, mobile communications hardware, near-field communication hardware, satellite communication hardware, and/or any wired or wireless hardware for communicating with other networks and/or devices.

The host vehicle warning system 100 may communicate, through the network interface hardware 140, with a network 172 to communicatively couple the system 100 to a mobile device 22 and/or other vehicles 20. A mobile device 22 may include any personal computing device including but not limited to, a mobile phone, laptop, tablet, or the like. In some embodiments, the one or more processors 102 send information as to the host vehicle 10 status to the approaching vehicle to warn the approaching vehicle that the host vehicle 10 is stopped in traffic. In some embodiments, the network interface hardware 140 may be used to communicate the warning to the user. For example, where the user has stepped out of the host vehicle 10, the warning may be transmitted to the user's mobile device 22 to ensure delivery of the warning to the user. Determination that the user has exited the vehicle may be based on signals from user sensors (not shown), which output an indication that the user has left the host vehicle 10. Such sensors may include interior vehicle cameras, door sensors, seat sensors (e.g., weight sensors), or the like.

It is also noted that in some embodiments, the one or more processors 102 may also execute logic to communicate at stopped signal through the network interface hardware 140 with other vehicles 20 that the host vehicle 10 is stopped in traffic. The stopped signal may include, for example, location information of the host vehicle 10. Such stopped signal may be displayed on a display, for example, of the other vehicle's infotainment system.

The network 172 may include one or more computer networks (e.g., a personal area network, a local area network, or a wide area network), cellular networks, satellite networks and/or a global positioning system and combinations thereof. Accordingly, the system 100 can be communicatively coupled to the network 172 via wires, via a wide area network, via a local area network, via a personal area network, via a cellular network, via a satellite network, etc. Suitable local area networks may include wired Ethernet and/or wireless technologies such as, for example, wireless fidelity (Wi-Fi). Suitable personal area networks may include wireless technologies such as, for example, IrDA, Bluetooth, Wireless USB, Z-Wave, ZigBee, and/or other near field communication protocols. Suitable personal area networks may similarly include wired computer buses such as, for example, USB and FireWire. Suitable cellular networks include, but are not limited to, technologies such as LTE, WiMAX, UMTS, CDMA, and GSM.

As noted above, the warning may be automatically output by the one or more user interface devices 120 in response to detection of a reckless approaching vehicle 20. As noted above reckless vehicles may be determined based on output of the one or more approaching vehicle sensors 130, which may detect erratic driving, swerving, drifting, virtual boundary violation, or the like. In some embodiments, a warning may only be output once the approaching vehicle 20 is a certain distance away. For example, within one 1 mile, within half a mile, within a quarter of a mile, within an eighth of a mile, etc. However, warnings provided within a greater distance are contemplated and possible.

It is noted that while FIG. 3 only illustrates a monitoring of a trailing vehicle for reckless driving, embodiments are not so limited. For example, the host vehicle warning system 100 may monitor and environment of the vehicle 360° around the vehicle to include on-coming traffic, trailing traffic, or vehicles coming from either side of the host vehicle 10.

Figure 2:
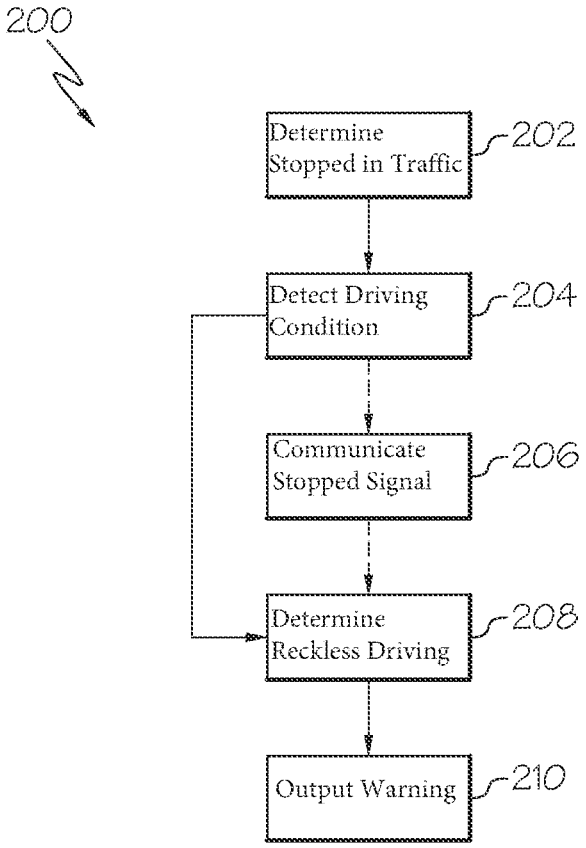
FIG. 2 depicts a flow chart illustrating a method, according to one or more embodiments shown and described herein.

Referring now to FIG. 2, a flow chart illustrating a method 200 for issuing a warning in response to detection of a recklessly driven vehicle. It is noted that though a discrete number of steps are shown in a particular order, a method 200 according to the present disclosure with a different number of steps in varying orders are contemplated and possible.

At step 202, the method 200 includes determining that the host vehicle 10 is stopped in traffic based on the status signal output by the one or more host vehicle status sensors 110. That is, the one or more processors 102 receive the status signal from the one or more host vehicle status sensors 110 and determines that the host vehicle 10 is stopped in traffic. For example, and with reference to FIG. 3, the host vehicle 10 is pulled over onto the shoulder 32 of the road 12. However, it is contemplated the host vehicle 10 may instead be stopped on the road 12, or for example, at a legal stop (e.g., stop sign, stop light, or like). In some embodiments, determining that the host vehicle 10 is stopped may include detecting with the one or more host vehicle status sensors 110 that the host vehicle 10 is stopped and detecting with the one or more approaching vehicle sensors 130 that one or more surrounding vehicles are moving relative to the host vehicle 10.

Referring again to FIG. 2, in embodiments including network interface hardware 140, the method 200 may further include, such as at step 206, communicating, with the network interface hardware 140, a stopped signal to an approaching vehicle 20 indicating that the host vehicle 10 is stopped in traffic. For example, the stopped signal may be communicated to other vehicles 20 through vehicle-to-vehicle communication and/or through the network 172.

Referring again to FIG. 2, in response to the vehicle being stopped in traffic, or in the process of stopping, at step 204, the host vehicle warning system 100 may detect a driving condition of an approaching vehicle 20 based on the driving condition signal output by the one or more approaching vehicle sensors 130. At step 208, the one or more processors 102 may determine based on the driving condition signal output by the one or more approaching vehicle sensors 130 that the approaching vehicle 20 is driving recklessly. For example, and as illustrated in FIG. 3, the approaching vehicle 20 is approaching the host vehicle 10. In the indicated example, the one or more approaching vehicle sensors 130 may output a signal to the one or more processors 102 indicative of the approaching vehicle 20 veering to the right. Such veering may be indicative of the approaching vehicle 20 being driven recklessly. Additionally, and as noted above, the approaching vehicle 20 has encroached the virtual boundary 24 set by the one or more approaching vehicle sensors 130, which may also indicate to the host vehicle warning system 100 that the approaching vehicle 20 is driving recklessly.

In response to determining that the approaching vehicle 20 is driving recklessly, at step 210 the method 200 further includes outputting with the one or more user interface devices 120 the warning. The warning may indicate to the user that a reckless vehicle is approaching and to take pre-emptive measures to avoid the approaching vehicle 20 (e.g., move out of the way). Such warning may be provided exterior of the host vehicle 10 (e.g., exterior speakers outputting warning noises, flashing lights, or the like) or interior of the host vehicle 10 (e.g., interior speakers outputting warning noises, interior flashing lights, visual alerts on the display or the like). In some embodiments, an audible warning may be issued by the one or more user interface devices 120 that instructs the user to "step away from the road." In some embodiments, the warning may be communicated through the network interface hardware 140 to a user's mobile device 22, such that an alert is provided through the mobile device 22 (e.g., text message, pop-up, sound, vibration, or the like).

It should now be understood that embodiments of the present disclosure are directed to systems and methods for issuing a warning in response to detection of a recklessly driven vehicle. In particular, such warnings are issued when a vehicle is stopped in traffic such as, for example, when the vehicle is disabled (e.g., due to a flat tire, engine failure, over-heating, or the like). In particular, the stopped vehicle, referred to herein as the "host vehicle" includes a host vehicle warning system. The host vehicle warning system generally includes one or more processors, one or more host vehicle status sensors, one or more approaching vehicle sensors, one or more user interface devices, and one or more memory modules. The one or more host vehicle status sensors output a status signal that a host vehicle is stopped in traffic. The one or more approaching vehicle sensors output a driving condition signal indicative of a driving condition of an approaching vehicle. The one or more user interface devices output a warning to a user of the host vehicle. The one or more memory modules store logic that cause the one or more processors to determine that the host vehicle is stopped in traffic, detect the driving condition of the approaching vehicle, determine whether the driving condition of the approaching vehicle is reckless, and output the warning in response to determining the approaching vehicle is reckless. Accordingly, a warning may be provided to the user of the disabled vehicle to warn the user of an oncoming reckless driver to allow the user to take preventative measures (e.g., step away from the host vehicle or the road).

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A host vehicle warning system, comprising:

one or more processors;

one or more host vehicle status sensors communicatively coupled to the one or more processors and configured to output a status signal that a host vehicle is stopped in traffic;

one or more approaching vehicle sensors communicatively coupled to the one or more processors and configured to output a driving condition signal indicative of a driving condition of an approaching vehicle;

one or more user interface devices communicatively coupled to the one or more processors and configured to output a warning to a user of the host vehicle; and one or more memory modules communicatively coupled to the one or more processors that store logic that when executed by the one or more processors cause the one or more processors to:

determine that the host vehicle is stopped in traffic based on the status signal output by the one or more host vehicle status sensors;

detect the driving condition of the approaching vehicle based on the driving condition signal output by the one or more approaching vehicle sensors;

determine whether the driving condition of the approaching vehicle is reckless based on the driving condition signal output by the one or more approaching vehicle sensors; and output the warning to the user of the host vehicle with the one or more user interface devices in response to determining that the driving condition of the approaching vehicle is reckless and the host vehicle is stopped in traffic.

2. The host vehicle warning system of claim 1, wherein the logic executed by the one or more processors cause the one or more processors to generate a virtual boundary, wherein the one or more processors output the warning with the one or more user interface devices in response to the approaching vehicle violating the virtual boundary.

3. The host vehicle warning system of claim 1, further comprising network interface hardware communicatively coupled to the one or more processors, wherein the logic executed by the one or more processors cause the one or more processors to:

communicate a stopped signal with the network interface hardware to the approaching vehicle indicating that the host vehicle is stopped in traffic.

4. The host vehicle warning system of claim 1, wherein determination that the host vehicle is stopped in traffic is determined by:

detection with the one or more host vehicle status sensors that the host vehicle is stopped; and detection with the one or more approaching vehicle sensors that one or more surrounding vehicles are moving relative to the host vehicle.

5. The host vehicle warning system of claim 1, wherein the one or more processors output the warning with the one or more user interface devices in response to the approaching vehicle driving about a predetermined speed.

6. The host vehicle warning system of claim 1, wherein the one or more approaching vehicle sensors include LiDAR, RADAR, a camera, vehicle-to-vehicle communication, or any combination thereof.

7. The host vehicle warning system of claim 1, wherein the one or more user interface devices include a display, a mobile device, one or more vehicle lights, one or more speakers, or any combination thereof.

8. The host vehicle warning system of claim 1, wherein the warning indicates to the user that a reckless vehicle is approaching and to take pre-emptive measures to avoid the approaching vehicle.

9. A method of issuing a warning in response to detection of a recklessly driven vehicle, the method comprising:

determining that a host vehicle is stopped in traffic based on a status signal output by one or more host vehicle status sensors;

detecting a driving condition of an approaching vehicle based on a driving condition signal output by one or more approaching vehicle sensors;

determining whether the driving condition of the approaching vehicle is reckless based on the driving condition signal output by the one or more approaching vehicle sensors; and outputting with one or more user interface devices a warning to a user of the host vehicle in response to determining that the driving condition of the approaching vehicle is reckless and the host vehicle is stopped in traffic.

10. The method of claim 9 further comprising generating a virtual boundary relative to the host vehicle, wherein the warning is output by the one or more user interface devices in response to the approaching vehicle violating the virtual boundary.

11. The method of claim 9, further comprising communicating, with network interface hardware, a stopped signal to the approaching vehicle indicating that the host vehicle is stopped in traffic.

12. The method of claim 9, wherein determining that the host vehicle is stopped comprises:

detecting with the one or more host vehicle status sensors that the host vehicle is stopped; and detecting with the one or more approaching vehicle sensors that one or more surrounding vehicles are moving relative to the host vehicle.

13. The method of claim 9, wherein the warning is output with the one or more user interface devices in response to the approaching vehicle driving above a predetermined speed.

14. The method of claim 9, wherein the one or more approaching vehicle sensors include LiDAR, RADAR, a camera, vehicle-to-vehicle communication, or any combination thereof.

15. The method of claim 9, wherein the one or more user interface devices include a display, a mobile device, one or more vehicle lights, one or more speakers, or any combination thereof.

16. A host vehicle warning system, comprising:

a host vehicle status sensor;

a approaching vehicle sensor;

a user interface device; and a control unit communicatively coupled to the host vehicle status sensor, the approaching vehicle sensor, and the user interface device, wherein the control unit:

determines that the host vehicle is stopped in traffic based on a status signal output by the one or more host vehicle status sensors;

determine whether a driving condition of the approaching vehicle is reckless based on a driving condition signal output by the one or more approaching vehicle sensors; and output the warning to the user of the host vehicle indicating a pre-emptive action with the one or more user interface devices in response to determining that the driving condition of the approaching vehicle is reckless and the host vehicle is stopped in traffic.

* * * * *